US010092049B2

(12) United States Patent
Courtial

(10) Patent No.: US 10,092,049 B2
(45) Date of Patent: Oct. 9, 2018

(54) SYSTEM FOR REVERSIBLY FASTENING A DECORATIVE LINING ON A SURFACE OF A LEATHERCRAFT ARTICLE MADE OF FLEXIBLE MATERIAL

(71) Applicant: ALTESSE, Saint-Martin-de-Valamas (FR)

(72) Inventor: Jean Paul Courtial, Saint-Agrève (FR)

(73) Assignee: ALTESSE, Saint-Martin-de-Valamas (FR)

( * ) Notice: Subject to any disclaimer, the term of this patent is extended or adjusted under 35 U.S.C. 154(b) by 0 days.

(21) Appl. No.: 15/610,626

(22) Filed: Jun. 1, 2017

(65) Prior Publication Data

US 2017/0347728 A1 Dec. 7, 2017

(30) Foreign Application Priority Data

Jun. 2, 2016 (FR) ..... 16 00895

(51) Int. Cl.

| | |
|---|---|
| ***A41D 27/08*** | (2006.01) |
| ***A41D 27/02*** | (2006.01) |
| ***A45C 3/08*** | (2006.01) |
| ***A45C 13/08*** | (2006.01) |
| ***A45C 3/06*** | (2006.01) |
| ***A45C 13/10*** | (2006.01) |
| *A41D 27/00* | (2006.01) |
| *A45C 3/00* | (2006.01) |

(52) U.S. Cl.

CPC ..... *A41D 27/08* (2013.01); *A41D 27/02* (2013.01); *A45C 3/06* (2013.01); *A45C 3/08* (2013.01); *A45C 13/08* (2013.01); *A45C 13/10* (2013.01); *A41D 27/00* (2013.01); *A45C 3/00* (2013.01)

(58) Field of Classification Search

CPC ..... A41D 27/08
USPC ..... 428/99
See application file for complete search history.

(56) References Cited

U.S. PATENT DOCUMENTS 5,533,558 A * 7/1996 Carey ..... A45C 3/08 150/105

* cited by examiner

*Primary Examiner* — Brent T O'Hern
(74) *Attorney, Agent, or Firm* — Joseph G. Chu; JCIP

(57) ABSTRACT

The invention proposes a system for reversibly fastening a decorative lining on the flexible surface of a leathercraft article enabling a regular, precise and immediate alignment. The system comprises a male part constituting a rigid brooch having decorative piercings and having a fastening face bearing N fastening buttons, N being an integer greater than or equal to 1, each button comprising a shank and a free bulging end wider than the shank, and at least one lug for translationally locking the decorative lining; a female part comprising as many button holes as the male part comprises buttons, each button hole being designed, in use, to be fastened in a permanent manner on the surface made of flexible material and to maintain in a reversible manner the bulging end of a button; the or each locking lug being intended to engage, in use, in an orifice cut into the decorative lining.

5 Claims, 2 Drawing Sheets

SYSTEM FOR REVERSIBLY FASTENING A DECORATIVE LINING ON A SURFACE OF A LEATHERCRAFT ARTICLE MADE OF FLEXIBLE MATERIAL

This application claims priority to the French Patent Application No. 1600895 filed on Jun. 2, 2016, the content of which is incorporated in its entirety herein.

BACKGROUND OF THE INVENTION

The invention relates to a system for reversibly fastening a decorative lining on a surface of a leathercraft article made of flexible material such as leather, fabric or similar material.

Modern methods of cutting metal sheets make it possible to produce, from metals such as steel, brass, copper, aluminium, silver or gold, varied and fine cuts-outs comprising in particular piercings of different shapes, to produce items of jewellery.

It is known to fasten in a permanent manner on the inner face of the cut metal sheet a slightly flexible lining appearing through openings in said metal sheet, having a different aspect and colours in order to produce a decorative aesthetic effect.

Preferably, for the inner lining flexible materials are used, such as natural or synthetic fabrics, or leather. The rigid metal sheet then gives the general shape of the item of jewellery, as well as an exterior aspect that is resistant to wear, which may be shiny, satin or matt, and the inner lining forms a more flexible and warmer material, of which the nature, the aspect and the colour clearly stand out on the metal and appears through the decorative piercings.

It is notably possible to produce bracelets, wristlets, belts, breastpins, ear pendants or chokers as well as rings and necklaces, comprising a cut metal sheet forming a rigid structure having a particular curve depending on its function. For example, bracelets formed in a strip of rolled metal sheet are produced, having an opening making it possible to pass the wrist in an adjusted manner.

BRIEF SUMMARY OF THE INVENTION

A first objective of the present invention is to be able to propose this type of decorative element for leathercraft articles. In this case, the decorative element is not worn directly on the skin of the user, but has to be fastened on a flexible surface, such as fabric, leather or similar materials.

Furthermore, a problem that is posed with this type of jewellery is that with an inner lining fastened in a permanent manner on the metal sheet by different means to ensure a good maintaining as well as a pinning under the metal sheet, it is then not possible to change this lining in a simple and rapid manner.

Thus, a detachment of the lining generally requires the use of specialised tooling to remove notably tightening screws or rivets, and may damage the elements. The dismantling and reassembly operation may be slow and delicate so as to conserve an impeccable aspect and a finish in order to justify the decorative function.

It is then not possible to produce rapidly variants of the same decorative element, by changing the lining or the decorative metal sheet, whereas it is sought more and more to personalise fashion accessories to adapt them for example to the clothes worn, the types of activities planned, or to a need for frequent renewal so as not to repeat a same decoration.

The objective of the present invention is notably to avoid these drawbacks of the prior art and to enable a reversible fastening of a decorative lining on a flexible surface of a leathercraft article.

Reversible fastening is taken to mean a fastening that can be done and undone without a tool. On the contrary, permanent fastening is taken to mean a fastening requiring a tool to be done or undone (crimping, screwing, bonding, etc.).

Furthermore, the fastening system must enable a regular, precise and immediate alignment of the decorative element of the leathercraft article. In other words, the user does not have to be concerned with alignment when fastening the decorative element in order that it is in the position prescribed by the manufacturer of the leathercraft article.

To this end, the invention relates to a system for reversibly fastening a decorative lining on a surface of a leathercraft article made of flexible material such as leather, fabric or similar material, the system comprising:

- a male part constituted of a rigid brooch having decorative piercings and having a fastening face bearing:
  - N fastening buttons, N being an integer greater than or equal to 1, each button comprising a shank and a free bulging end wider than the shank, and
  - at least one lug for translationally locking the decorative lining;
- a female part comprising as many button holes as the male part comprises buttons, each button hole being designed, in use, to be fastened in a permanent manner on the surface made of flexible material and to maintain in a reversible manner the bulging end of a button;
- the or each locking lug being intended to engage, in use, in an orifice cut into the decorative lining.

According to the invention, the reversible fastening of the brooch on the leathercraft article and the translational locking of the decorative lining between the brooch and the leathercraft article are dissociated. This enables a very precise reversible fastening in position of the brooch on the leathercraft article, while facilitating the change of the lining which is simply arranged between the brooch and the leathercraft article.

According to particular embodiments:

- the shank of each button may have a length such that, in position of use, when the free end of the or each button is engaged in the button hole(s), the decorative lining is compressed between the brooch and the surface of the leathercraft article;
- the fastening system may comprise two fastening buttons each arranged near to two opposite ends of the brooch, and at least one translational locking lug arranged between the two fastening buttons;
- the bulging end of the fastening buttons may be spherical and the female parts may be crimped in the leathercraft article in such a way that the fastening buttons and the button holes form press fasteners; and/or
- each female part may be a casing fastened onto the surface of the leathercraft article, each casing comprising a fastening face provided with a button hole constituted of a hole of diameter at least equal to the diameter of the bulging end and an oblong notch emerging in the hole and of diameter greater than the diameter of the shank of each button and less than the diameter of the bulging end of each button.

The invention also relates to a decorative element for a leathercraft article comprising a surface made of flexible material such as leather, fabric or similar material, the decorative element comprising a decorative lining and a preceding reversible fastening system.

The invention also relates to a leathercraft article comprising a surface made of flexible material such as leather, fabric or similar material, a decorative lining and a preceding reversible fastening system.

Advantageously, the leathercraft article may comprise, moreover, a set of interchangeable decorative linings and/or a set of brooches bearing different decorative piercings.

The invention also relates to a decorative kit for a leathercraft article comprising a set of interchangeable decorative linings and/or a set of brooches for a preceding reversible fastening system and each bearing different decorative piercings.

The invention also relates to a decorative lining intended to cooperate with a preceding reversible fastening system and comprising as many orifices as the male part of the fastening system comprises translational locking lugs, the orifices being arranged so as to receive, in use, the locking lug(s).

Each orifice may either traverse right through the lining, or be blind and only traverse the lining over a part of its thickness.

BRIEF DESCRIPTION OF THE DRAWINGS

Other characteristics of the invention will be set forth in the description detailed hereafter, made with reference to the appended drawings, which respectively represent.

DETAILED DESCRIPTION OF THE PREFERRED EMBODIMENTS

The decorative element according to the invention is intended to be fastened on a leathercraft article M so as to be able to change decorative lining easily, without any tool, and in a precise manner.

Figure 1:
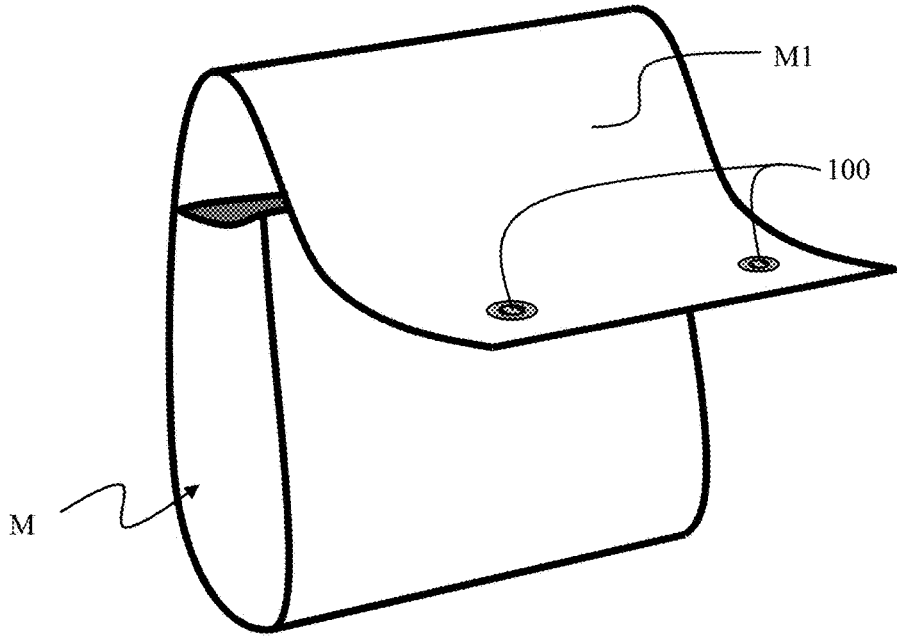
FIG. 1, a schematic view in perspective of a leathercraft article provided with a first embodiment of a female part of the fastening system according to the invention.

FIG. 1 illustrates, as an example, a pouch made of leather M, comprising two button holes 100 of press fasteners crimped in the flexible surface M1 of the flap.

Figure 2:
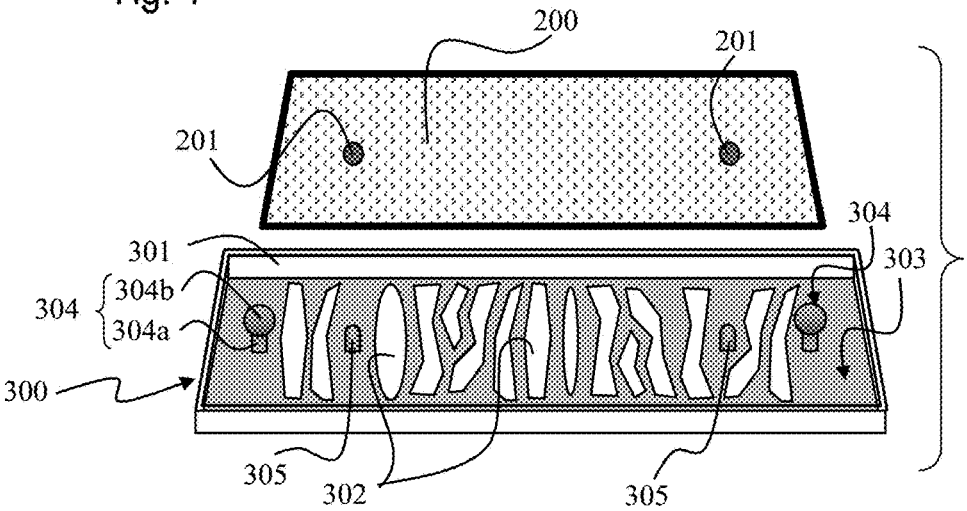
FIG. 2, a schematic view in perspective of a decorative lining and of a first embodiment of the male part of the fastening system according to the invention before mounting.
Figure 3:
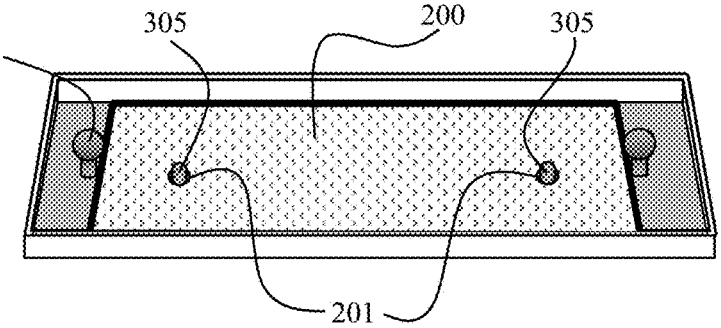
FIG. 3, a schematic view in perspective of the lining and of the male part illustrated in FIG. 2 assembled, before fastening to the female part of the leathercraft article of FIG. 1.

Each button hole 100 is thus designed, in use, to be fastened in a permanent manner on the surface made of flexible material and to maintain in a reversible manner the remainder of the fastening system and the decorative lining illustrated in FIGS. 2 and 3.

FIG. 2 illustrates a lining 200 and a first embodiment 300 of the male part of the fastening system according to the invention According to the invention, the male part 300 is constituted of a rigid brooch 301 having decorative piercings 302 and having a fastening face 303.

The latter bears as many fastening buttons as the female part comprises button holes. In the example illustrated, the fastening face 303 bears two buttons 304 each comprising a shank 304*a* and a free bulging end 304*b* wider than the shank 304*a*. In this embodiment, the free bulging end 304*b* is spherical and constitutes the male part of a press fastener.

Also according to the invention, the fastening face 303 bears, moreover, at least one lug 305 for translationally locking the decorative lining 200. In the example illustrated, the two fastening buttons 304 are each arranged near to two opposite ends of the brooch 301, and the lugs 305 for translationally locking are arranged between the two fastening buttons 304.

Advantageously, the locking lugs are arranged symmetrically so as to enable a positioning of the lining on its two faces, thus increasing the aesthetic possibilities if the two faces have different aspects.

The decorative lining 200 comprises as many orifices 201 as the male part 300 of the fastening system comprises translational locking lugs 305, the orifices being arranged so as to receive, in use, the locking lug (s) 305.

As illustrated in FIG. 3, the or each locking lug is intended to be engaged, in use, in an orifice 201 cut into the decorative lining 200.

During assembly, the user covers the decorative piercings 302 with the lining 200 and translationally locks it by inserting the locking lugs 305 in the orifices 201.

Advantageously, the lining has sufficient dimensions to be able to be flush with the shanks 304*a* of the button 304.

According to an advantageous embodiment of the invention, the shank 304*a* of each button 304 has a length L1 (see FIG. 4) such that in position of use, when the free bulging end 304*b* of the or each button 304 is engaged in the button hole(s) 100, the decorative lining is compressed between the brooch 301 and the surface M1 of the leathercraft article M.

Figure 4:
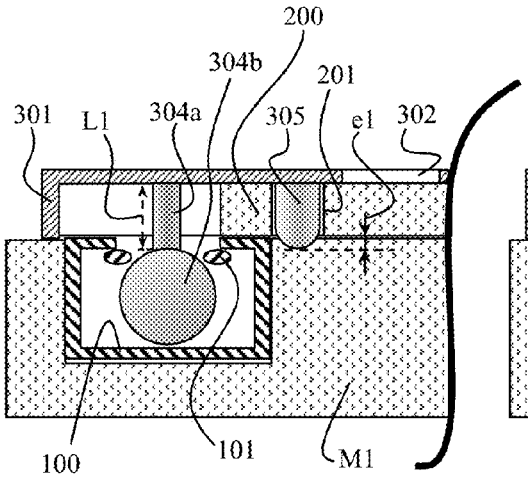
FIG. 4, a schematic view in section of a first embodiment of locking lugs of a fastening system according to the invention.
Figure 5:
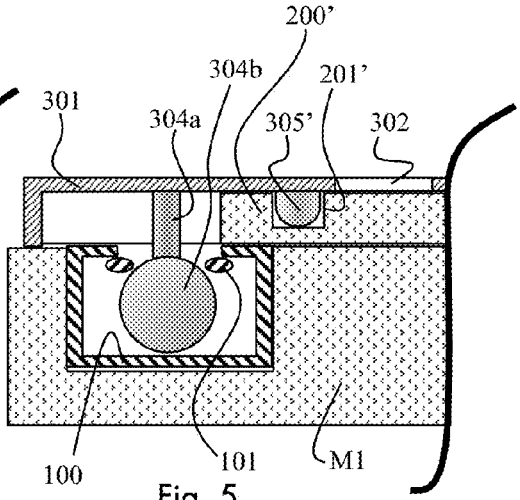
FIG. 5, a schematic view in section of a second embodiment of locking lugs of a fastening system according to the invention.

According to two variants illustrated in FIGS. 4 and 5, the orifices 201 may be either through orifice, or blind orifices.

The lining 200 of the variant illustrated in FIG. 4 comprises orifices 201 traversing right through the lining.

Advantageously, the brooch 301 of the variant illustrated in FIG. 4 comprises translational locking lugs 305 which have a length such that they slightly exceed the thickness of the lining 200. Thus, in position of use, when the buttons 304 are engaged in the button holes 100 and retained by the reversible locking means 101 of the button hole (here a spring), the lugs 305 exert a local compression e1 against the flexible surface M1 of the article M. This ensures both an optimum translational locking of the lining 200, while facilitating the removal of the brooch by spring effect.

The lining 200' of the variant illustrated in FIG. 5 comprises blind orifices 201', that is to say not traversing right through the lining but only a part of its thickness.

This embodiment enables the translational locking of the lining while avoiding the rubbing of the lugs 305' against the surface of the leathercraft article M.

In a similar manner to the variant of FIG. 4, the length of the lug 305' may be chosen slightly greater than the depth of the orifice 201' when the decorative lining 200 is flexible (for example made of leather). Thus, in position of use, when the buttons 304 are engaged in the button holes 100 and retained by the reversible locking means 101 of the button hole, the lugs 305' exert a local compression against the bottom of the orifice 201' and, because the lining and the surface of the leathercraft article are flexible, against the flexible surface M1 of the article M. This ensures both an optimum translational locking of the lining 200, while facilitating the removal of the brooch by spring effect.

The buttons 304 do not pin the decorative lining 200 onto the fastening face of the brooch because the buttons are not in contact with the decorative lining. Only the locking lugs 305 cooperate with the decorative lining, either in compression, or in abutment, in order to block the translational movement of the decorative lining.

The fastening position of the brooch 301 is thus precise because it is determined by the cooperation of the buttons and the button holes. The locking of the lining may be a little less precise because the decorative piercings do not go beyond the lining 200. It thus suffices to lock it translationally to prevent its edges appearing through the piercings 302 of the brooch 301.

This simple maintaining enables an easy replacement by the user who only has to separate the brooch 301 from the button holes 100 by simple traction, to remove the lining 200 from the lugs 305 and to replace it or to turn it over before repositioning everything. This removal may advantageously be facilitated by the spring effect created by the compression zones of the locking lugs.

Figure 6:
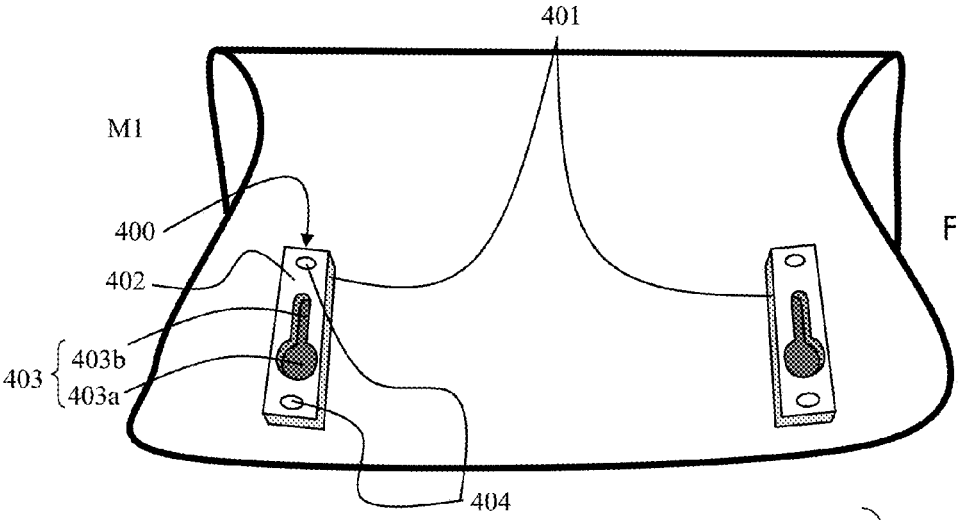
FIG. 6, a schematic view in perspective of a second embodiment of a female part of the fastening system according to the invention.
Figure 7:
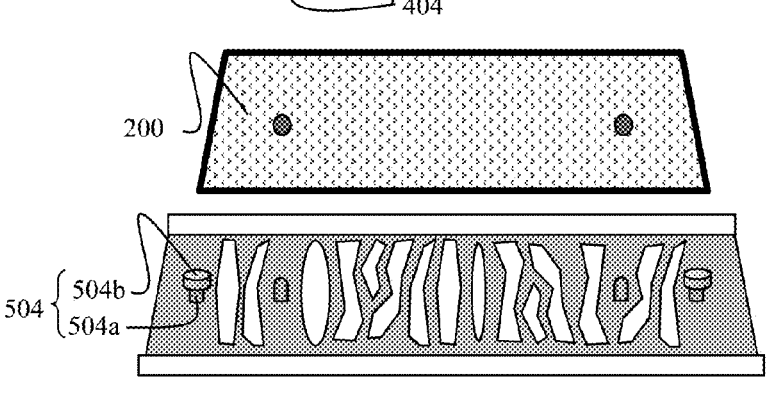
FIG. 7, a schematic view in perspective of a decorative lining and of a second embodiment of the male part of the fastening system according to the invention before mounting then fastening to the female part of the leathercraft article of FIG. 6.

A second embodiment of the invention is illustrated in FIGS. 6 and 7.

In this second embodiment, each female part 400 is a casing 401 fastened on the surface of the leathercraft article by bonding, screwing or crimping.

Each casing 401 comprises a fastening face 402 provided with a button hole 403 constituted of a hole 403*a* of diameter greater than the diameter of the bulging end 504*b* of the button 504 of the male part (see FIG. 7) and of an oblong notch 403*b* emerging in the hole 403*a* and of diameter greater than the diameter of the shank 504*a* of each button 504 and less than the diameter of the bulging end 504*b* of each button 504.

In this embodiment, the user engages the bulging part of each button in the hole 403*a*, then exerts a translational movement to make the shank slide into the notch.

Advantageously the bulging part is substantially cylindrical and may have a chamfered shape to favour the pinning of the brooch against the leathercraft article when the shanks of the buttons are engaged in the oblong notches of the button holes. Alternatively, or in combination, the maintaining in position may be ensured by two magnets 404 arranged on either side of the button hole.

The invention also relates to a leathercraft article comprising a surface made of flexible material such as leather, fabric or similar material, a decorative lining and a system for reversibly fastening the decorative lining such as described previously. Advantageously, the leathercraft article is supplied with a set of interchangeable decorative linings and/or a set of brooches bearing different decorative piercings.

The invention also pertains to a decorative kit for a leathercraft article comprising a fastening system such as described previously and a set of interchangeable decorative linings and/or a set of brooches bearing different decorative piercings.

Many alterations and modifications may be made by those having ordinary skill in the art without departing from the spirit and scope of the invention. Therefore, it must be understood that the illustrated embodiments have been set forth only for the purposes of examples and that they should not be taken as limiting the invention as defined by the following claims. For example, notwithstanding the fact that the elements of a claim are set forth below in a certain combination, it must be expressly understood that the invention includes other combinations of fewer, more or different ones of the disclosed elements.

The words used in this specification to describe the invention and its various embodiments are to be understood not only in the sense of their commonly defined meanings, but to include by special definition in this specification the generic structure, material or acts of which they represent a single species.

The definitions of the words or elements of the following claims are, therefore, defined in this specification to not only include the combination of elements which are literally set forth. In this sense it is therefore contemplated that an equivalent substitution of two or more elements may be made for any one of the elements in the claims below or that a single element may be substituted for two or more elements in a claim. Although elements may be described above as acting in certain combinations and even initially claimed as such, it is to be expressly understood that one or more elements from a claimed combination can in some cases be excised from the combination and that the claimed combination may be directed to a subcombination or variation of a subcombination.

Insubstantial changes from the claimed subject matter as viewed by a person with ordinary skill in the art, now known or later devised, are expressly contemplated as being equivalently within the scope of the claims. Therefore, obvious substitutions now or later known to one with ordinary skill in the art are defined to be within the scope of the defined elements.

The claims are thus to be understood to include what is specifically illustrated and described above, what is conceptually equivalent, what can be obviously substituted and also what incorporates the essential idea of the invention.

The invention claimed is:

1. A fastening system for reversibly fastening a decorative lining on a surface of a leathercraft article made of flexible material, the system comprising:

a male part comprising a rigid brooch having decorative piercings and having a fastening face, the fastening face comprising:

N fastening buttons, N being an integer greater than or equal to 1, wherein each button comprises a shank and a free bulging end wider than the shank, and at least one translational locking lug for translationally locking a decorative lining;

a female part comprising N button holes, each button hole configured to be fastened in a permanent manner on a surface made of a flexible material, said each button hole configured to secure in a reversible manner the free bulging end of a button;

wherein each locking lug is configured to engage with an orifice cut into the decorative lining.

2. The fastening system according to claim 1, wherein the shank of said each button has a length (L1) such that when the free bulging end of said each button is engaged in the button hole, the decorative lining is compressed between the brooch and a surface of a leathercraft article.

3. The fastening system according to claim 1, wherein the N fastening buttons comprises two fastening buttons each of the two fastening buttons arranged near to two opposite ends of the brooch, wherein said at least one translational locking lug is arranged between the two fastening buttons.

4. The fastening system according to claim 1, in which the free bulging end of the N fastening buttons is spherical and the female part is crimped in a leathercraft article in such a way that the N fastening buttons and the button holes form press fasteners.

5. The fastening system according to claim 1, in which the female part is a casing fastened on a surface of a leathercraft article, each casing comprising the fastening face provided with the button hole comprising a hole of a diameter greater than a diameter of the free bulging end, and an oblong notch emerging in the hole and of a diameter greater than a diameter of the shank of each button and less than the diameter of the free bulging end of said each button.

* * * * *